United States Patent [19]

Daroga

[11] Patent Number: 4,631,872

[45] Date of Patent: Dec. 30, 1986

[54] NUCLEAR BLAST AND FALL-OUT SHELTER

[76] Inventor: Nader D. Daroga, 80 Addiscombe Court Road, East Croydon, Surrey CR0 6TS, United Kingdom

[21] Appl. No.: 568,963

[22] Filed: Jan. 6, 1984

[30] Foreign Application Priority Data

Jan. 12, 1983 [GB] United Kingdom ..... 8300775

[51] Int. Cl.[4] ..... E04H 9/04

[52] U.S. Cl. ..... 52/1; 52/169.6; 98/31.5; 109/1 S; 165/16; 165/45

[58] Field of Search ..... 52/169.6, 1, 169.1, 52/20; 109/1 S; 98/31, 31.5; 165/16, 45; 236/49

[56] References Cited

U.S. PATENT DOCUMENTS

| | | | |
|---|---|---|---|
| 3,173,387 | 3/1965 | Cree, Jr. | 52/169.6 X |
| 3,196,813 | 7/1965 | McHugh, Jr. | 52/169.6 X |

FOREIGN PATENT DOCUMENTS

| | | | |
|---|---|---|---|
| 304751 | 4/1955 | Switzerland | 52/169.6 |
| 494232 | 10/1938 | United Kingdom | 52/169.6 |
| 2075570 | 11/1981 | United Kingdom | 52/169.6 |
| 2121950 | 1/1984 | United Kingdom | 52/169.6 |

OTHER PUBLICATIONS

Technical Manual, Gasproof Shelters, U.S. War Dept., May 12, 1943, pp. 9–52.

*The Electrolysis of Water,* Joseph W. Richards, pp. 22, 23 & 76–80, 1904.

*Primary Examiner*—John E. Murtagh

*Assistant Examiner*—Richard E. Chilcot, Jr.

*Attorney, Agent, or Firm*—James C. Wray

[57] ABSTRACT

The invention provides a nuclear blast and fall-out shelter to contain a number of persons completely enclosed for several weeks and is provided with oxygen supply means, air conditioning means, and hand operated pump for introducing external air if required, the oxygen, $CO_2$ and CO contents all being controlled to maintain life for the occupants.

12 Claims, 6 Drawing Figures

SECTION A-A

-17-

SECTION B-B

SECTION B-B

NUCLEAR BLAST AND FALL-OUT SHELTER

OBJECT OF THE INVENTION

This invention relates to a shelter for the life support and protection of persons against nuclear blast and fall-out and its main object is to provide a self contained capsule for the protection of human beings against nuclear, biological and chemical hazards in times of emergency and which essentially covers a gas, air and water tight container or capsule with complete life support system capable of sustaining life for a minimum of six weeks.

SUMMARY OF THE INVENTION

According to the invention I provide a shelter chamber provided therein with:

1. Oxygen supply means.
2. Flowmeter and supply for the oxygen.
3. Oxygen delivery ducting for introducing the oxygen into the chamber.
4. An intake ducting for intake of air from the chamber.
5. An air purifying means for removing CO and $CO_2$ from the air.
6. Air delivery ducting for delivering purified air to the chamber.
7. Means to draw air from said air ducting and send the air through the purifying means and into said delivery ducting.
8. Means for measuring proportion of CO and $CO_2$ in the air in the chamber and giving an alarm signal in case of danger.
9. An air intake duct for drawing external air into said chamber.
10. Hand operated means for drawing external air into the chamber through said air intake duct.
11. An over-pressure valve for controlling air pressure in said chamber.

The air intake ducting may extend along the upper part of the chamber and the air delivery ducting and oxygen delivery ducting may both extend along the lower part of the chamber.

BRIEF DESCRIPTION OF THE DRAWINGS

The chamber may also be provided with various other desirable features and devices as will be further described by way of example with reference to the accompanying diagrammatic drawings wherein.

DESCRIPTION OF PREFERRED EMBODIMENTS

Figure 1:
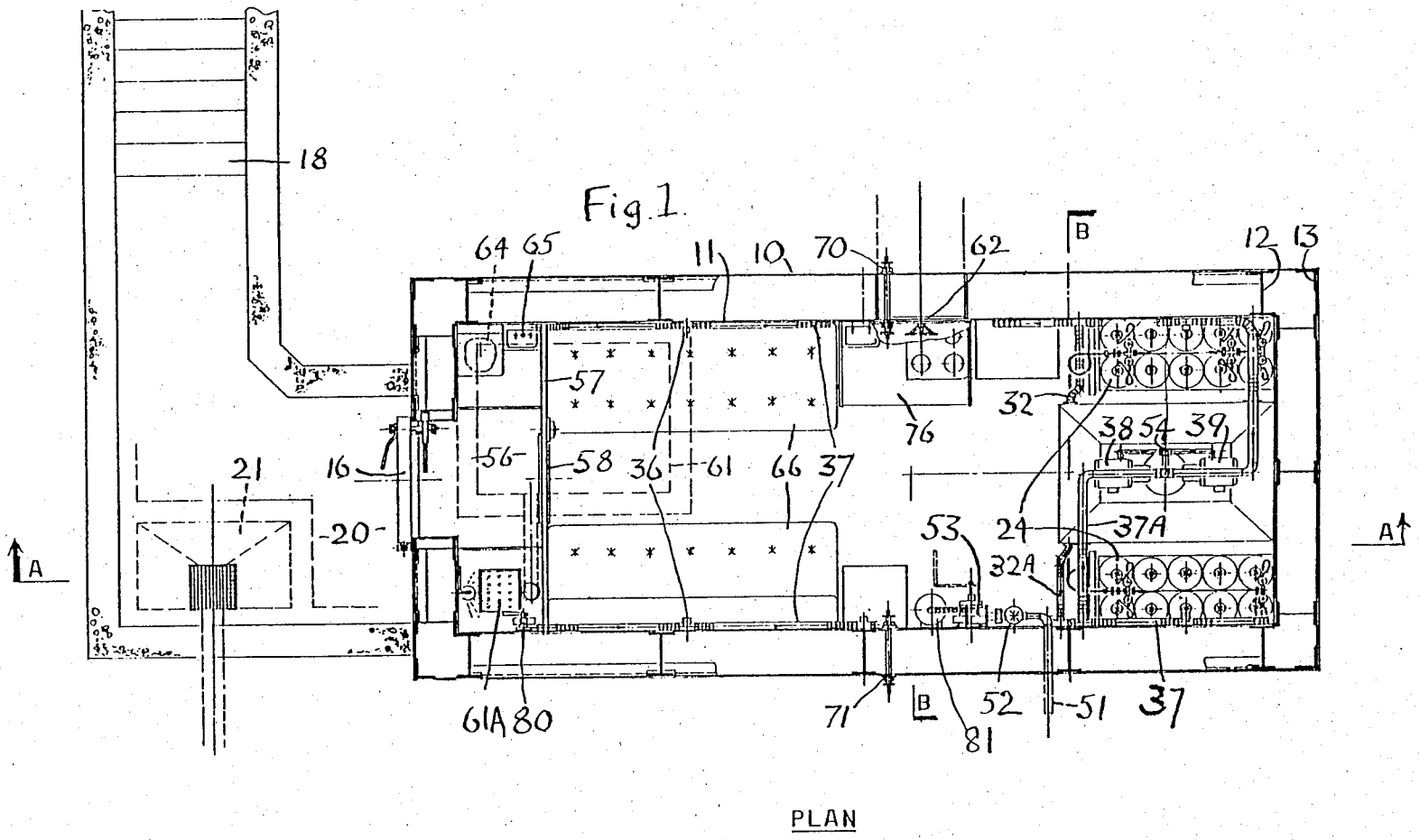
FIG. 1 is a plan view of a shelter made in accordance with the invention but omitting the roof.
Figure 2:
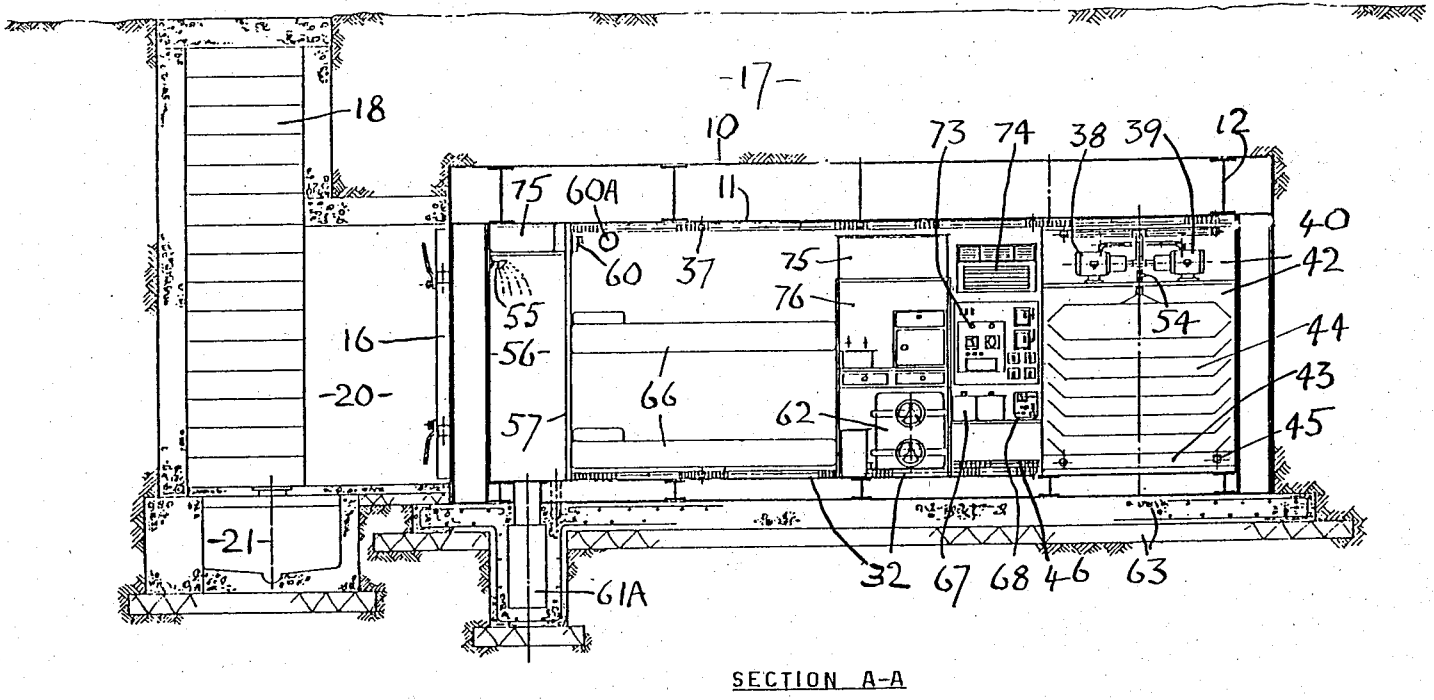
FIG. 2 is a sectional view of the plane A—A on FIG. 1 omitting some control parts.
Figure 3:
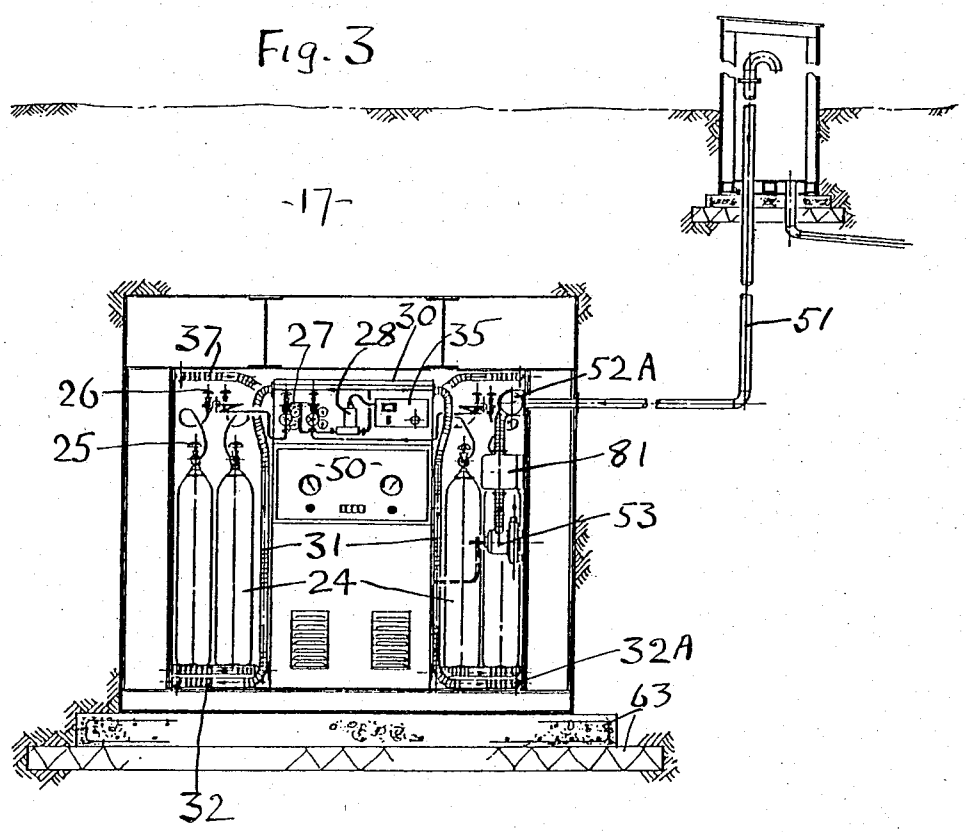
FIG. 3 is a sectional view on the plane B—B on FIG. 1.

The shelter shown in FIGS. 1 to 3 is formed by double steel sheet walls 10, 11 spaced apart by steel I-beams 12 and attached together at the corners by angle plates 13, thus forming a chamber closed on all six sides (including top and bottom) except for an entry closed by an air-tight door 16 and an escape hatch 62. The shelter will be below ground covered by a layer 17 of earth or concrete. The entry to the chamber is by way of steps 18 and initial entry room 20. A rain-water sump 21 is disposed at the bottom of the steps.

The chamber is provided an one end with two sets of ten oxygen cylinders 24 and outlets of which pass through normal valves 25, ancillary valves 26, automatic changeover devices 27, and flowmeter 28, into a pipe 30 which leads to ducting 31 which passes down to horizontal ducting 32,32A which extends along the bottom of the chamber on both sides thereof. A controller 35 automatically controls the flowmeter 28 to maintain the proportion of oxygen in the atmosphere in the chamber to approximately 18 to 21 percent by volume.

Air from the chamber is withdrawn continuously or intermittently through openings 36 in ducting 37 which extend along the upper part of the chamber on both sides thereof. This withdrawn air is propelled by either of two fans 38,39 driven by electric motors. The output from these fans enters a pipe 40 which opens at its ends into a closed compartment 42. The air descends through chemicals such as soda-lime, activated carbon cloth and catalyst material contained in trays or the like 44 to remove carbon dioxide, odours and carbon monoxide. The background concentration of carbon dioxide and carbon monoxide is monitored by analysers and the values are displayed. The air if filtered by filtration pads at 43 and leaves by outlets 45 and enters air discharge ducting 46, which extends along both sides of the chamber at the lower part thereof.

An automatic life support system control unit 50 is also installed for measuring the $CO_2$ and CO content of the atmosphere in the chamber and giving a visual and/or audible alarm to enable the occupants to change the fans or make other changes.

An air intake for external air is shown at 51 and this is provided with a valve 52 which is normally closed. It can be opened if required and air drawn in by means of a hand operated pump 53 through a filter 81. The air from this pump is conveyed by piping to a connector 54 (FIG. 2) whence it descends through the absorption means at 44 and filter 43 and exits into the chamber by ducting 46. 52A is an anti-blast valve.

An over-pressure valve 60 serves to balance pressure between the chamber and the chamber 56 and an over-pressure valve 60A serves to expel over-pressure air to the exterior atmosphere.

A decontamination chamber 56 is divided from the living chamber by a wall 57 having a door 58. The chamber 56 has a shower nozzle 55 and a storage 61 for waste contaminated water. 61A is toilet waste.

The emergency escape hatch is shown at 62.

Concrete or other foundation at 63, toilet 64, hand basin 65, folding beds 66, batteries 67, battery charger 68, power terminal 70 to external town electricity supply, terminal 71 to external Diesel driven electric supply, electric control panel 73; air conditioning temperature controller 74, water tank 75, kitchen 76 (with cooker, food cupboard etc.) and hand operated sump pump 80, other devices such as a radiator and radiation meter, pedal charge generator, walky-talkie radio and television monitoring unit, may be provided. A tool box is also provided containing shovels and other means, as also means of generating private electric power supply.

Figure 4:
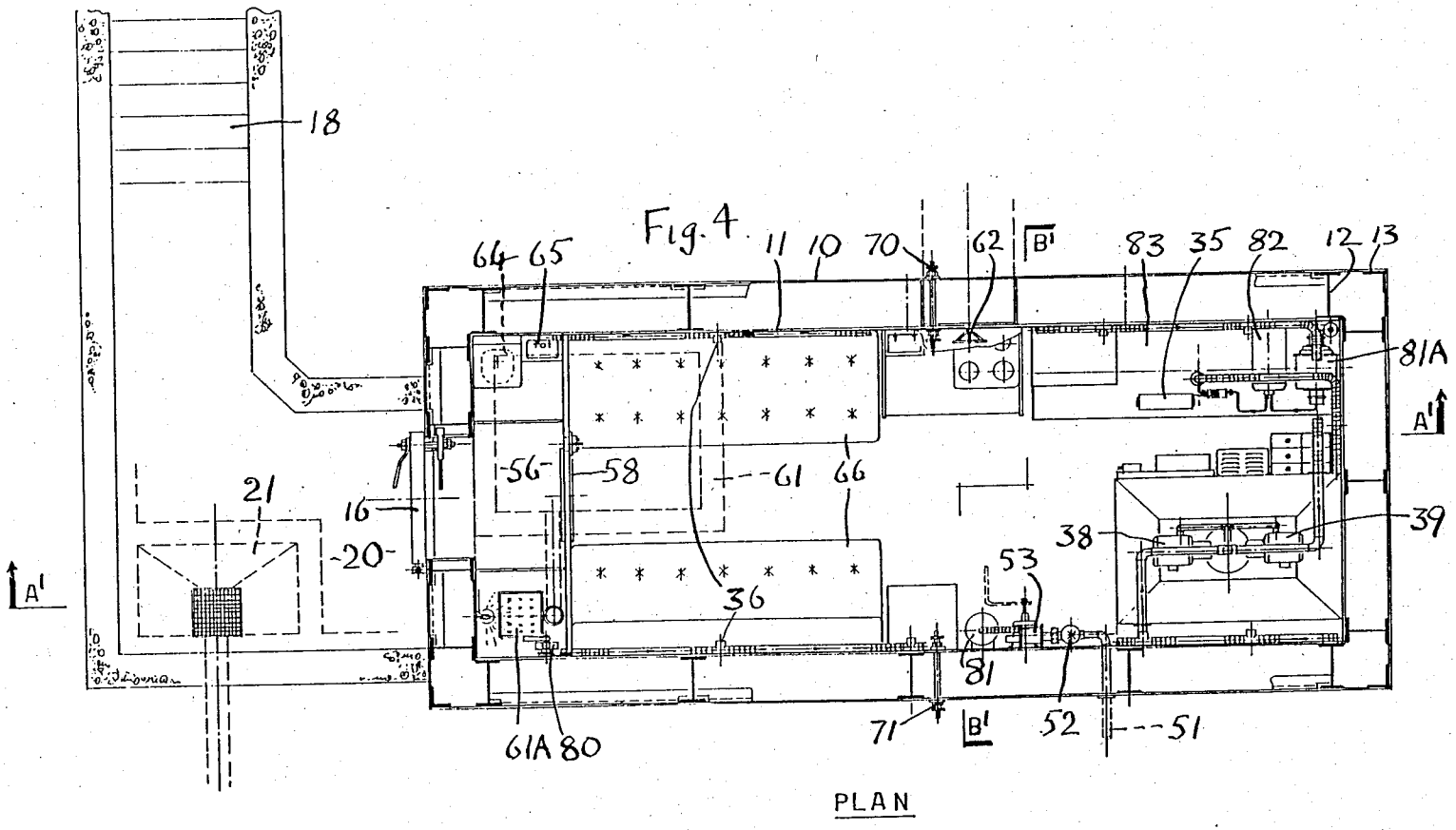
FIG. 4 is a plan view of a modified form of the shelter.
Figure 5:
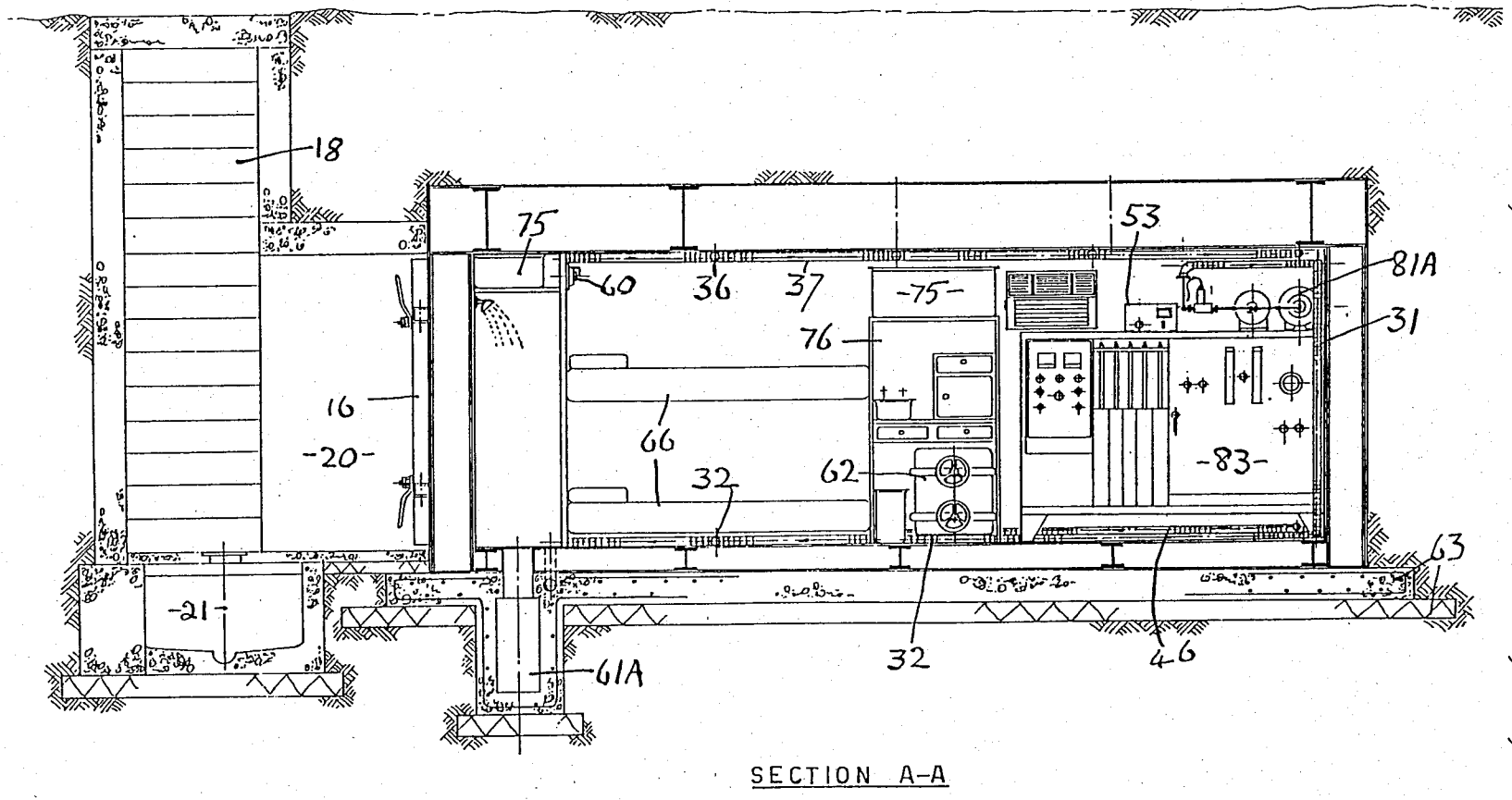
FIG. 5 is a sectional view on the plane A'—A' on FIG. 4.
Figure 6:
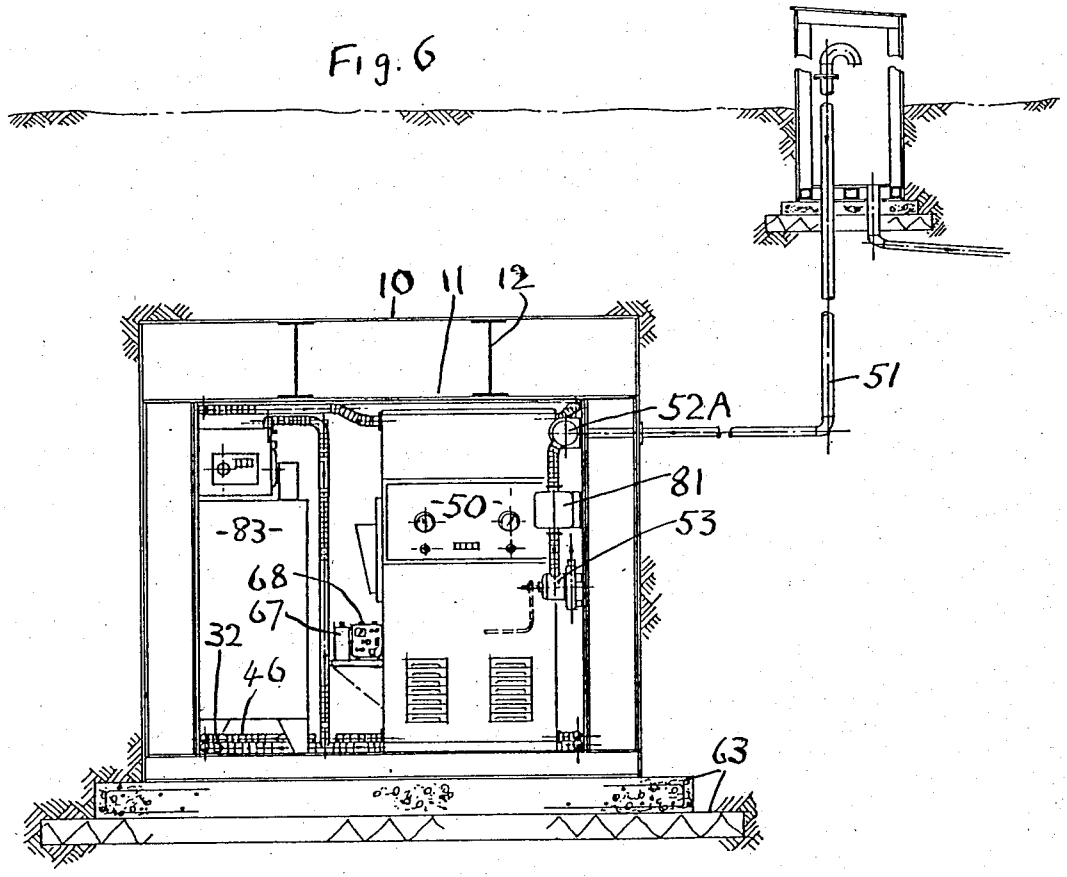
FIG. 6 is a sectional view on the plane B'—B' on FIG. 4.

The alternative contruction shown in FIGS. 4,5 and 6 is similar to that above described except that in place of the oxygen cylinders an automatically controlled apparatus 83 is provided for producing oxygen by electrolysis of water. The oxygen is passed through a filter 81A and drier 82 and is fed to the oxygen ducting 32 as before. The hydrogen produced can be exhausted from the chamber.

The capsule can be cylindrical, cubical or of any other shape, made from steel, concrete, reinforced concrete, lead-clad steel or any suitable material or metal of adequate strength and size for the capacity to which it is designed.

The volume and floor area of the capsule will be as per International Standards relating to shelters of this type.

The construction of the capsule can be welded, rivetted, cast or jointed in an approved manner so as to render the capsule gas, air and water-tight in all respects. Construction will incorporate shielding from heat and electronic interference.

The shelter can contain up to five or more persons completely enclosed up to six weeks or more.

I claim:

1. A nuclear blast and fall-out shelter having a chamber, oxygen supply means disposed within the chambers, a flowmeter and an automatic controller connected to the oxygen supply means for controlling the supply of oxygen, oxygen delivery ducting connected to the flowmeter for introducing the oxygen into the chamber, an intake ducting in the chamber for intake of air from the chamber, an air purifying means connected to the intake ducting for removing CO and $CO_2$ from the chamber air, air delivery ducting connected to the purifying means for delivering purified air to the chamber, means connected to the intake ducting to draw air through said air intake ducting and send the air through the purifying means and into said delivery ducting, means in the chamber for automatically measuring the proportion of CO and $CO_2$ in the air in the chamber and giving an alarm signal in case of danger, an air intake duct connected to the chamber for drawing external air into the chamber through said air intake duct, hand operated means connected to the intake duct for drawing external air into the chamber through said air intake duct, and over-pressure valve means connected to the chamber for controlling air pressure in said chamber.

2. A shelter as claimed in claim 1, said air intake ducting extending along an upper part of the chamber and the air delivery ducting and oxygen delivery ducting extending along the lower part of the chamber.

3. A shelter as claimed in claim 1 wherein said means to draw air through said air intake ducting comprise two fans arranged for receiving air from the air intake ducting and driving the air through the air purifying means and a filter into the air delivery ducting.

4. A shelter as claimed in claim 1 having steps leading to an initial entry room separated by airtight door from a decontamination compartment which is separated by a wall and door from the chamber.

5. A shelter as claimed in claim 1 having electric power terminals extending through the walls of the chamber for respective connection to the district supply and to a Diesel powered generator.

6. A shelter as claimed in claim 1 wherein the oxygen supply means comprises oxygen cylinders associated with auxiliary valves, automatic change over means, said flowmeter and said automatic controller to maintain the proportion of oxygen in the chamber at 18 to 21 volume per cent.

7. A shelter as claimed in claim 1 wherein the oxygen supply means comprises a water electrolysis plant and the oxygen is passed through a filter and a drier and the hydrogen from the electrolysis is exhausted from the chamber.

8. A shelter as claimed in claim 1 wherein the walls are double steel sheet walls separated by steel beams.

9. A nuclear blast and fall-out shelter comprising, a chamber having spaced apart double steel sheet walls separated by steel I-beams, a plurality of oxygen supply tanks disposed within a portion of the chamber, a flowmeter and automatic control means, connected to the plurality of oxygen supply tanks, for automatically releasing oxygen into the chamber through first ducting disposed along a lower portion of the chamber, exhausting means, connected to ducting disposed along an upper portion of the chamber, for withdrawing air from within the chamber, and for delivering the air through a soda-lime filter back to the chamber through second ducting disposed along the lower portion of the chamber, and means, disposed within the chamber, for measuring the proportion of CO and $CO_2$ in the chamber air, and for alarming occupants of dangerous levels of CO and $CO_2$.

10. The apparatus of claim 9 further comprising, an external air intake being normally closed by a valve, and having a hand operated pump connected to the air intake for delivering external air through a first filter and then through the soda-lime filter.

11. The apparatus of claim 9 further comprising, a rain water sump disposed at the bottom of stairs leading to the chamber entrance.

12. The apparatus of claim 9 wherein the exhausting means comprise two fans connected to electric motors and being operable in response to an unsafe level of CO and $CO_2$ as measured by the means for measuring the proportion of CO and $CO_2$ in the chamber air.

* * * * *